US006000962A

United States Patent [19]

Daoud

[11] Patent Number: 6,000,962

[45] Date of Patent: Dec. 14, 1999

[54] WIRE PASS THROUGH DEVICE FOR AN INSULATION DISPLACEMENT CONNECTOR

[75] Inventor: Bassel Hage Daoud, Parsippany, N.J.

[73] Assignee: Lucent Technologies Inc., Murray Hill, N.J.

[21] Appl. No.: 09/103,326

[22] Filed: Jun. 23, 1998

[51] Int. Cl.[6] ..... H01R 4/24

[52] U.S. Cl. ..... 439/395; 439/400

[58] Field of Search ..... 439/395, 399, 439/400

[56] References Cited

U.S. PATENT DOCUMENTS 4,913,659 4/1990 Doyle ..... 439/395

*Primary Examiner*—Michael L. Gellner
*Assistant Examiner*—Antoine Ngandjui

[57] ABSTRACT

A device for selectably passing a wire through a cap of an insulation displacement connector to a point beyond the connector. A wire is inserted into a passage in the cap and exits the passage through an exit aperture in the cap. A stop wall is positioned in spaced confronting relationship with the exit aperture. The stop wall is dimensioned and shaped so that when the wire exits the exit aperture, the wire contacts the stop wall and is inhibited from passing beyond the stop wall, yet when the wire is selectively guided around the stop, the wire is passed beyond the connector.

12 Claims, 5 Drawing Sheets

WIRE PASS THROUGH DEVICE FOR AN INSULATION DISPLACEMENT CONNECTOR

FIELD OF THE INVENTION

This invention relates to a tool-less insulation displacement connector and, in particular, to a wire pass through device for selectively routing a wire exiting the first connector beyond the connector for facilitating further connections.

BACKGROUND OF THE INVENTION

Telephone lines, which are carried by electrical conductors known as tip ring wires pairs, originate from a central office (CO) and are aggregated at a particular point in a building prior to being distributed and connected to various types of telephone equipment, such as, for example, telephones, fax machines, modems etc., in the building. The tip ring wire pairs, which generally enter the building as part of a multi-conductor cable, are connected to a junction box known as, for example, a building entrance protector (BEP) or network interface unit (NIU). Within the junction box, the individual telephone line tip ring wire pairs are separated from the cable, individually connected to a connector block, and made available for further electrical connection and distribution.

The connector block, also known as an insulation displacement connector (IDC) block, may be the ubiquitous punch down connector block, also known as a 66-type connector block, or the tool-less insulation displacement connector block utilizing punch cap connectors, such as that described in the U.S. Pat. No. 4,913,659 dated Apr. 3, 1990, the entire disclosure of which is incorporated herein by reference. The IDC connector block is commercially available under the product designation SC99 from Lucent Technologies Inc.

The tool-less insulation displacement connector block includes an IDC type connector on one side of the connector block. The IDC connector includes a connector cap that is moveable from an up position, for facilitating insertion of the wire, to a down position, where the wire is brought into mechanical and electrical contact with a terminal strip disposed in the IDC connector. Opposite the IDC on the other side of the connector block is a matching, electrically connected wire wrap end of the terminal strip, such that a wire connected on the wire wrap side may be connected to another wire coupled to the IDC side of the block.

In operation, the connector cap of the IDC connector is initially in the up position and a tip ring wire is inserted into an entrance aperture in the connector cap. The wire is then urged through a wire passage disposed in the connector cap until it exits the cap through an exit aperture. After the wire is inserted through the connector cap, the connector cap is pushed down which causes the wire to be gripped by the terminal. Typically, the portion of the tip ring wire that extends beyond the exit aperture in the connector cap is trimmed so that the wire is flush with the connector cap surface. In this way, the excess wire does not interfere with other connectors on the connector cap. However, in some instances, it is desirable to pass the tip ring wire from the connector to another connector on the connector block so that a single tip ring wire pair may be branched across multiple terminals.

A significant drawback of the prior art IDC connectors is that when the portion of the tip ring wire that exits the IDC connector is trimmed, the trimmed section can fall on the connector block and cause an electrical short between terminals on the block, or fall into the BEP or NIU or other associated equipment. Furthermore, the step of trimming the excess wire portion is labor intensive, especially when wire density is high, which increases the cost associated with installation of the connector block. Accordingly, there exists a need in the art for a device that eliminates the need to trim the excess portion of the tip ring wire while also selectably providing for the routing of the wire from the connector to other connectors on the connector block, or to other connection points.

SUMMARY OF THE INVENTION

The present invention is directed at overcoming the shortcomings of the prior art. The present invention is directed to a wire pass through device for providing the selective pass through of a wire inserted through a connector to a point beyond the connector, or if no pass through is required, to limit the extent to which the wire extends beyond the connector to eliminate trimming. The wire pass through device of the present invention includes a stop adjacent to or formed on the cap of the connector and in spaced confronting relationship with an exit aperture disposed on the connector cap. The stop is dimensioned and shaped so that when the wire exits the exit aperture, the wire contacts the stop and is not passed beyond the stop. In those instances where it is desired to extend the wire beyond the connector, however, the wire may be easily guided around the stop, the wire then being easily pulled to any desired point. Because the stop prevents the portion of the wire that extends beyond the exit aperture from interfering with other connectors on the connector block, the need to trim the wire is eliminated.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWING FIGURES

In the drawing figures, which are not to scale, and which are merely illustrative, and wherein like reference numerals depict like elements throughout the several views.

DETAILED DESCRIPTION OF THE PREFERRED EMBODIMENTS

Figure 1:
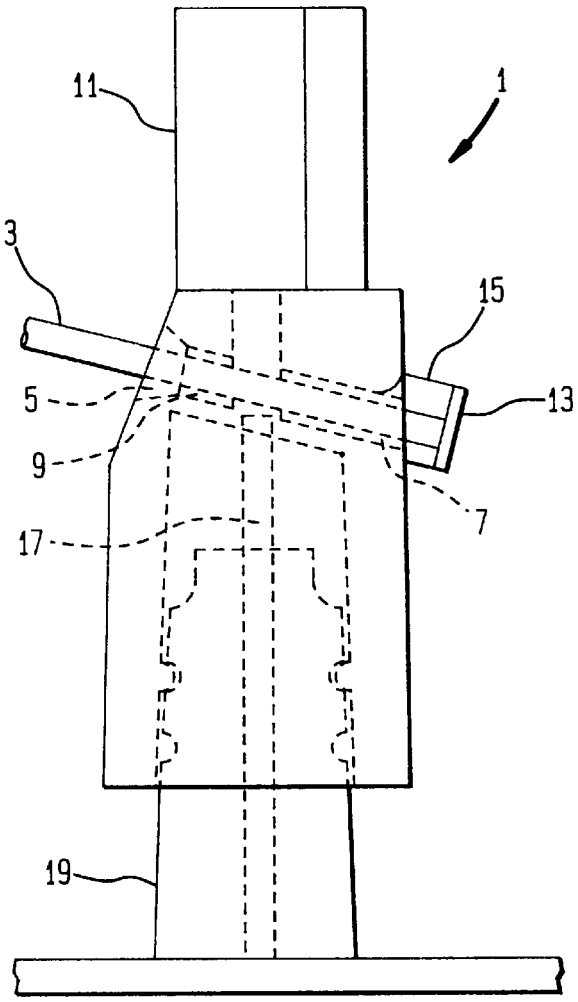
FIG. 1 is a side elevational view of a wire pass through device constructed in accordance to the present invention.
Figure 2:
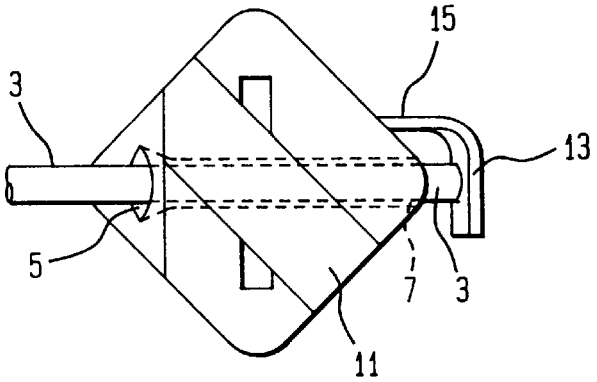
FIG. 2 is a top view of the wire pass through device of FIG. 1.
Figure 3:
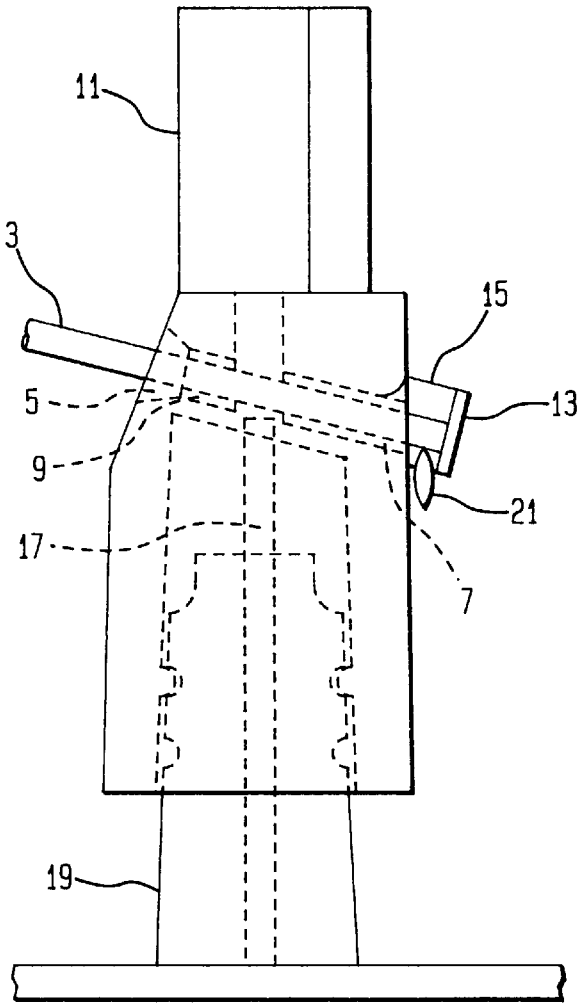
FIG. 3 is a side elevational view of the wire pass through device of the present invention showing a tool being used for guiding the wire beyond the stop.
Figure 4:
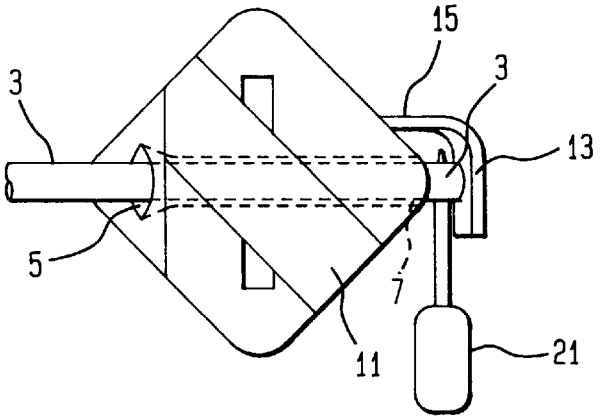
FIG. 4 is a top view of the wire pass through device of FIG. 3.

Referring now to FIGS. 1–3, there is shown a wire pass through device 1 constructed in accordance to the present invention. The wire pass through device of the present invention, generally indicated at 1, is disposed on a connector cap 11 of an IDC connector 19. Connector cap 11 includes an entrance aperture 5 in fluid communication with a wire passage 9. A wire 3 is inserted into entrance aperture 5 and is urged through wire passage 9, causing wire 3 to pass directly above a terminal strip 17 disposed in connector 19. Wire 3 exits connector cap 11 through an exit aperture 7 that is also in fluid communication with wire passage 9. As used herein the term wire means any elongated conductor, insulated or non-insulated, commonly encountered in the electrical and/or electronic arts. Additionally, while a single connector block 19 is depicted and described, it is intended that the invention herein be applicable to multiple connectors arranged in arrays on connector blocks in a manner known in the art, it being understood that the invention herein may be applied to any one IDC connector, group of IDC connectors, or all IDC connectors on a connector block, as a matter of application specific design choice.

Wire pass through device 1 includes a stop support 15 positioned proximate exit aperture 7. A stop wall 13 is disposed on one end of stop support 15. Stop support 15 and stop wall 13 together preferably form an L-shaped member that is dimensioned, shaped and positioned so that stop wall 13 is in spaced confronting relationship with exit aperture 7. The space between stop wall 13 and exit aperture 7 is sufficiently narrow so that when wire 3 exits exit aperture 7, wire 3 will contact stop wall 13 and will not extend beyond stop wall 13 so as not to interfere with other connectors or terminals on the connector block. The distance between stop wall 13 and exit aperture 7 is, however, sufficiently designed so that when it is desired to guide wire 3 around stop wall 13, a tool or implement 21 can be inserted between stop wall 13 and exit aperture 7 to guide wire 3 around stop wall 13 for passage therebeyond.

Although stop support 15 may be placed in any position which results in stop wall 13 being in spaced confronting relationship with exit aperture 7, in an exemplary embodiment stop support 15 is fixed to connector cap 11 adjacent exit aperture 7. Also, it is preferred that stop support 15 and stop wall 13 be made from non-conducting material and integrally formed on the surface of connector cap 11 as a single molded plastic unit suitable for injection molding in a single manufacturing step.

Referring now to FIGS. 3–7, the operation of wire pass through 1 will be described. Initially, in preparation for a wire being inserted therein, connector cap 11 is in the up position. Wire 3 is inserted into entrance aperture 5 and is urged through wire passage 9 until it exits exit aperture 7. After exiting exit aperture 7, wire 3 contacts stop wall 13 which prevents further forward movement of wire 3. If it is not desired to pass wire 3 to another connector on the connector block, connector cap 11 is pushed down forcing wire 3 to be gripped by terminal 17 (Not shown). Because of the relatively close positioning of stop wall 13 relative to exit aperture 7, wire 3 does not extend beyond exit aperture 7 in a manner that would interfere with other connectors on the connector block. As a result, the need to trim the portion of wire 3 that extends beyond exit aperture 7 is eliminated.

Figure 5:
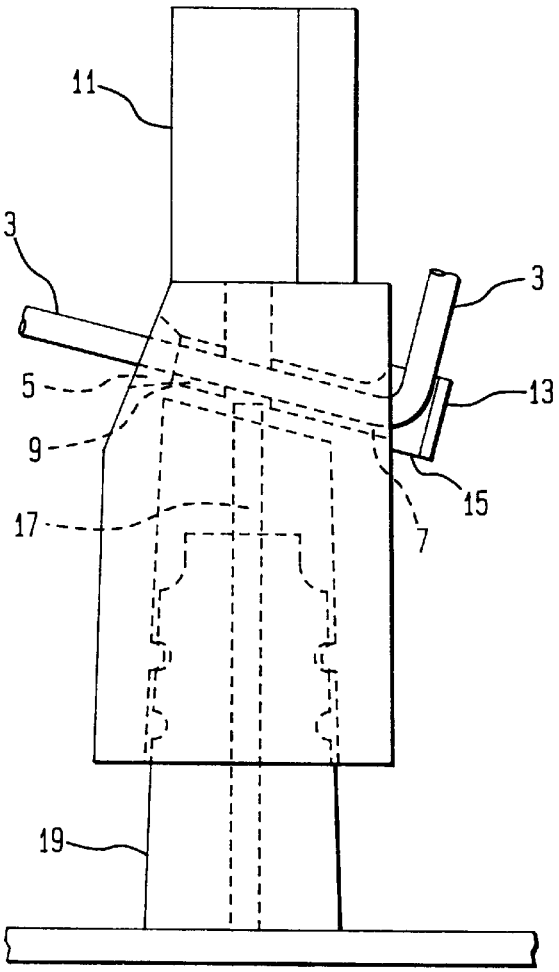
FIG. 5 is a side elevational view of the wire pass through device of the present invention showing the wire guided around the stop.
Figure 7:
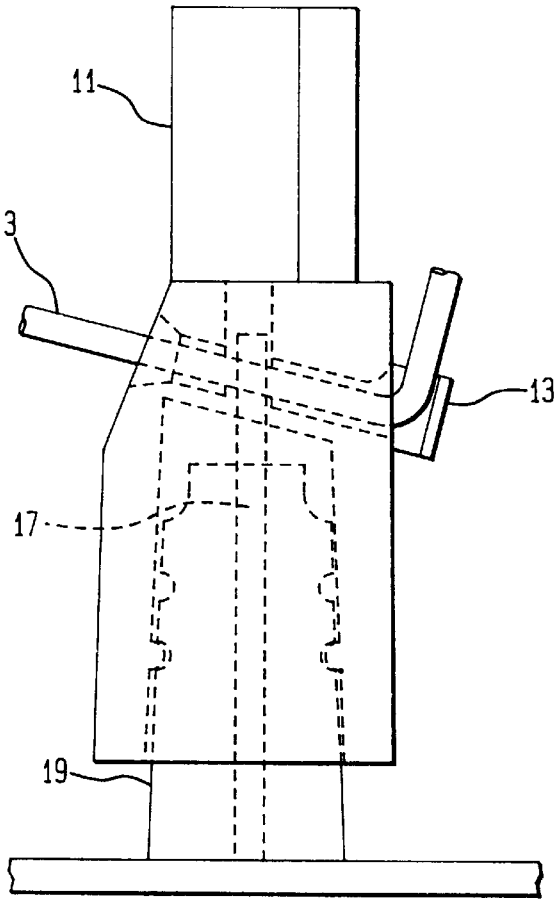
FIG. 7 is a side elevational view of the wire pass through device showing the connector cap in the down position.
Figure 6:
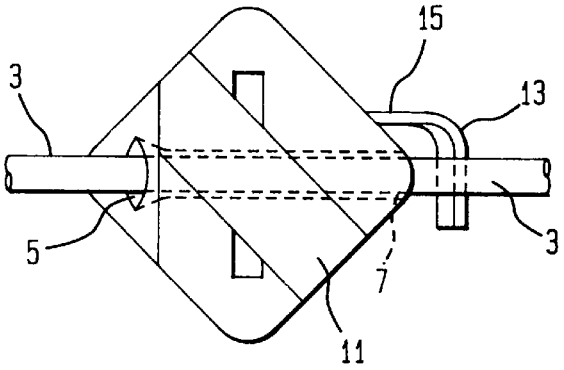
FIG. 6 is a top view of the wire pass through device of FIG. 5.

On the other hand, if it is desired to pass wire 3 beyond connector 19 to another connector on the connector block, or some other point, a tool 21 is inserted between exit aperture 7 and stop wall 13 (FIGS. 3 and 4) to guide wire 3 around and out of engagement with stop wall 13, thereby making wire 3 available for connection to other connectors on the connector block or elsewhere (FIGS. 5 and 6). After wire 3 is positioned in the desired manner, the cap 11 may be pushed downward, as seen in FIG. 7, to drive wire 3 into mechanical and electrical engagement with terminal strip 17, in a manner known in the art. Tool 21 may be any elongated, slender, probe-like tool or implement, such as, for example, a screwdriver, awl, hook, or the like.

Figure 8:
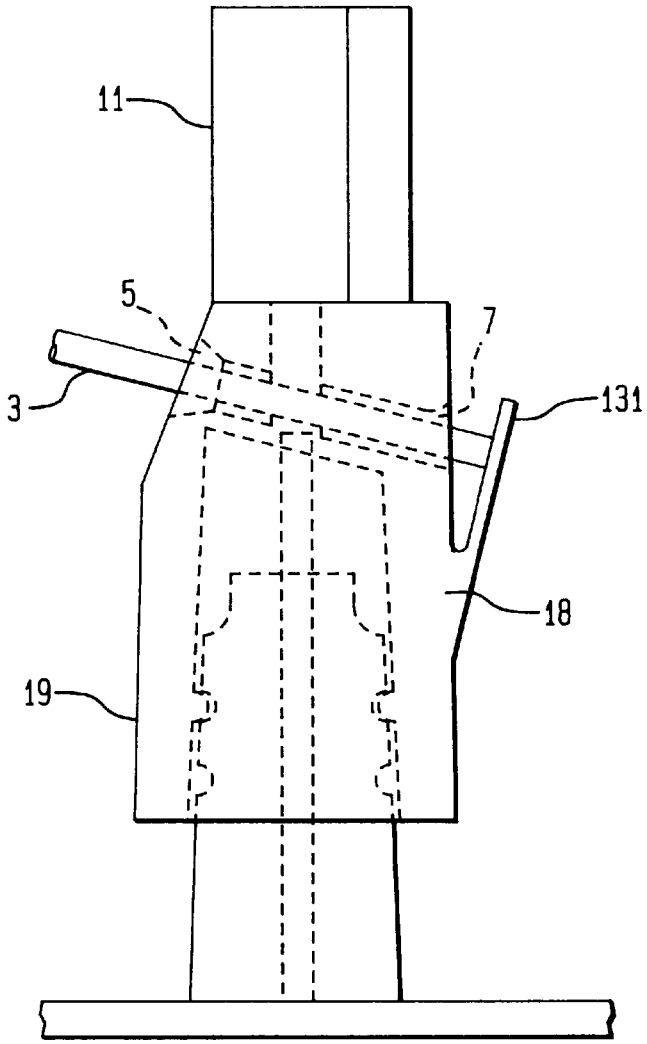
FIG. 8 is a side elevational view of an alternative embodiment of the wire pass through device of the present invention.

Referring now to FIG. 8, there is shown an alternative embodiment of wire pass through 1 constructed in accordance with the present invention. Elements identical to that of the previous embodiment are like numbered and a detailed description of such elements is omitted.

In the alternative embodiment, stop wall 131 is disposed on connector cap 11 at a point 18 below exit aperture 7. Stop wall 131 extends upwardly and outwardly from point 18 so that an upper portion of stop wall 131 is in spaced confronting relationship with exit aperture 7. The space between stop wall 131 and exit aperture 7 is sufficiently narrow that when wire 3 exits exit aperture 7 and abuts stop wall 131, whereupon its further passage beyond the connector 19 is inhibited, wire 3 does not interfere with other connectors or terminals on the connector block, as discussed above. The space between stop wall 131 and exit aperture 7 is sufficiently wide, however, that when it is desired to guide wire 3 around stop wall 131, a tool 21 can be inserted between stop wall 131 and exit aperture 7 to guide wire 3 around stop wall 131. In an exemplary embodiment, stop wall 131 is integrally formed with connector cap 11 as a single molded plastic unit.

Figure 9:
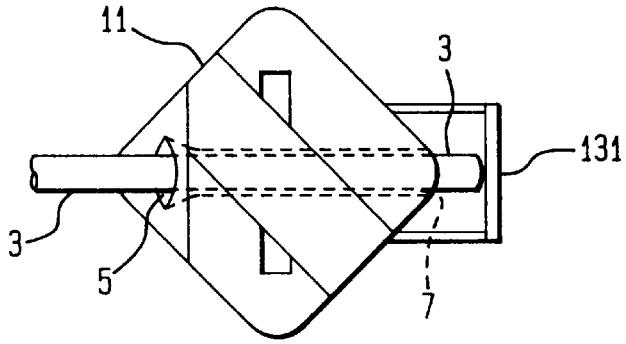
FIG. 9 is a top view of the wire pass through device of FIG. 8.

As seen in FIGS. 8 and 9, the operation of wire pass through 1 constructed in accordance with the alternative embodiment comports with the embodiment described above. As in the previous embodiment, wire 3 is inserted into entrance aperture 5 and urged through wire passage 9 towards exit aperture 7. After wire 3 exits exit aperture 7, wire 3 is contacted by stop wall 131 thus impeding the further progress of wire 3. If it is not desired to pass through wire 3 to another connector, connector cap 11 is pushed down so that wire 3 is gripped by terminal 17 (not shown). Because of the closely proximate position of stop wall 131 relative to exit aperture 7, wire 3 does not interfere with other connectors on the connector board, and trimming is unnecessary.

Figure 10:
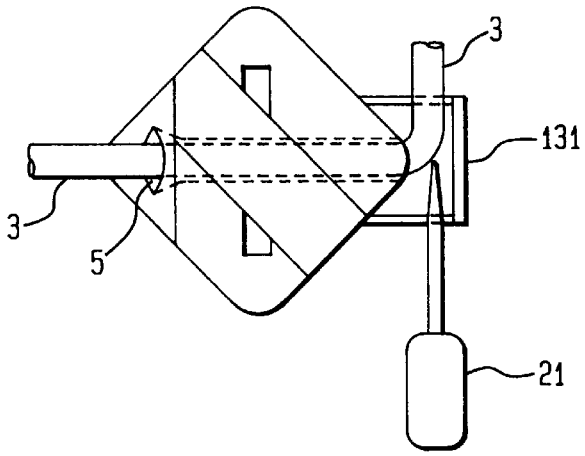
FIG. 10 is a top view of the wire pass through device of FIG. 8 showing the wire guided around the stop by an implement.

As seen in FIG. 10, if it is desired to pass wire 3 from connector 19 to another connector on the connector block, tool 21 is inserted in the space between exit aperture 7 and stop wall 131 and wire 3 is guided out of engagement and around stop wall 131 so that wire 3 is available for connection to other connectors on the connector block or passage elsewhere.

Accordingly, through the provision of wire pass through 1 of the present invention, the need to perform the laborious step of trimming the portion of wire 3 that extends beyond exit aperture 7 is eliminated, while the ability to pass through wire 3 from connector 19 to other connectors on the connector block or other application driven connection points is preserved.

Figure 11:
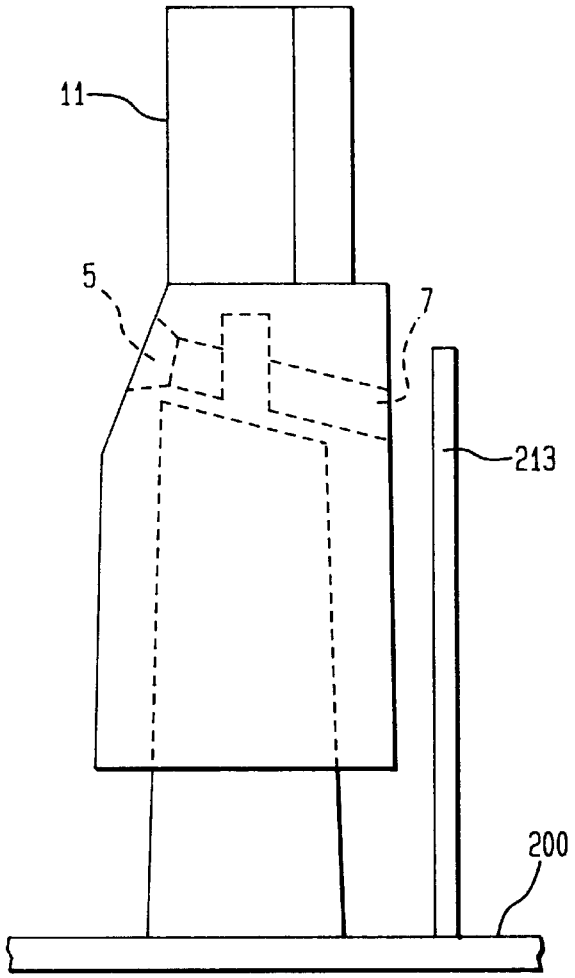
FIG. 11 is a side elevational view of an alternative embodiment of the wire pass through device of the present invention.

While stop wall 13, 131 is described as preferably integrally formed on cap 11, the person of skill will recognize that it need not be, and the stop wall can be a separate part that is either removably or fixedly attached to the cap via numerous art recognized fastening techniques, such as for example, by adhesives such as glues and epoxies, by screwing, snap fitting, or the like. Or, the stop wall can be independent of the cap, being instead upstanding from a common base alongside the connector, as seen in FIG. 11, where a stop wall 213 is depicted adjacent exit aperture 7 and integrally formed, or fixedly or removably mounted by an art recognized fastening methodology, upon a common connector base 200. Connector base 200 may be, for example, a surface of a base of an IDC connector block.

Moreover, the shape, dimensioning and orientation of the stop wall embodiments described above may be varied to suit numerous application specific design parameters such as wire size, connector density, enclosure type, etc., provided that the stop wall is so configured relative to the cap that it inhibits the wire's passage beyond the connector to an extent which reduces or eliminates the need for trimming, while selectably permitting the wire to be moved out of engagement with the stop wall for further connection or passage elsewhere beyond the connector. Additionally, the use of a tool or implement may be optional, the bypassing of the stop wall being achieved by manual manipulation of the wire.

Thus, while there have been shown and described and pointed out fundamental novel features as applied to preferred embodiments thereof, it will be understood that various omissions and the substitutions and changes in the form and details of the disclosed invention may be made by those skilled in the art without departing from the spirit of the invention. It is the intention, therefore, to be limited only as indicated by the scope of the claims appended hereto.

What is claimed is:

1. A device for selectably permitting a wire passing through a cap of an insulation displacement connector to extend beyond said cap, said device comprising a stop wall positioned at a distance from and in spaced confronting relation with an exit aperture in said cap through which said wire is passed and extends, said stop wall being dimensioned and shaped so that when said wire exits said exit aperture and traverses said distance said wire abuts said stop wall and its further passage is inhibited, said distance being so dimensioned as to permit said wire to be selectably guided out of abutment with said stop wall so that said wire can be passed beyond said cap and said stop wall.

2. The device of claim 1, wherein said stop wall is mounted on said cap at a point below said exit aperture and extends upwardly from said point and outwardly from said cap so that a portion of said stop wall is in spaced confronting relationship with said exit aperture.

3. The device of claim 1, wherein said distance is dimensioned such that a tool can be inserted between said exit aperture and said stop wall to guide said wire out of abutment with and around said stop wall.

4. The device of claim 1, wherein said stop is constructed from a non-conducting plastic material.

5. The device of claim 1, wherein said connector is mounted on a base and wherein said stop wall is mounted to and upstanding from said base.

6. The device of claim 1, wherein said cap is deployed on an insulation displacement connector that is one of an array of insulation displacement connectors mounted on a connector block.

7. The device of claim 1, wherein said stop wall further comprises a support portion and a stop portion disposed on and supported by said support portion such that a portion of said stop portion is in spaced confronting relationship with said exit aperture.

8. The device of claim 7, wherein said support portion is connected to said cap.

9. The device of claim 1, wherein said stop is integrally formed with said connector as a single molded unit.

10. The device of claim 9, wherein said molded unit is formed by injection molding.

11. A cap for an insulation displacement connector comprising:

an entrance aperture for receiving a wire;

an exit aperture in fluid communication with said entrance aperture via a wire passage, said exit aperture permitting said wire to be passed and to extend through said wire passage and beyond said exit aperture; and a stop wall formed on an outer surface of said cap proximate said exit aperture and outside said wire passage for selectably inhibiting the extent to which said wire may pass beyond said exit aperture.

12. The cap of claim 11, wherein said cap is deployed on an insulation displacement connector that is one of an array of insulation displacement connectors mounted on a connector block.

* * * * *